United States Patent [19]

Garley et al.

[11] Patent Number: 4,510,876

[45] Date of Patent: Apr. 16, 1985

[54] METHOD FOR POSITIONING TWO WORKPIECE PORTIONS FOR STITCHING TOGETHER ALONG A DESIRED STITCHING PATH

[75] Inventors: Anthony M. Garley, Oakham; Rita A. Stafford, Birstall, both of England

[73] Assignee: USM Corporation, Farmington, Conn.

[21] Appl. No.: 571,721

[22] Filed: Jan. 18, 1984

[30] Foreign Application Priority Data

Jan. 20, 1983 [GB] United Kingdom ..... 8301542

[51] Int. Cl.[3] ..... D05B 1/00

[52] U.S. Cl. ..... 112/262.1; 112/121.12; 112/121

[58] Field of Search ..... 112/262.1, 121.12, 121.15

[56] References Cited

U.S. PATENT DOCUMENTS

| | | | |
|---|---|---|---|
| 1,174,750 | 3/1916 | Mayo | 112/121.12 |
| 3,739,733 | 6/1973 | Schramayr | 112/121.12 |
| 4,130,073 | 12/1978 | Kimura et al. | 112/121.12 |
| 4,217,838 | 8/1980 | Portilla | 112/121.12 |

FOREIGN PATENT DOCUMENTS

| | | | |
|---|---|---|---|
| 2900049 | 7/1979 | Fed. Rep. of Germany | 112/121.12 |
| 2900002 | 7/1979 | Fed. Rep. of Germany | 112/121.12 |

*Primary Examiner*—Ronald Feldbaum
*Attorney, Agent, or Firm*—Donald N. Halgren

[57] ABSTRACT

A method of positioning two workpiece portions for stitching together along a desired stitching path.

A pallet is provided for positioning workpiece components (e.g. a vamp V and quarter portions RQ, LQ of a shoe upper) in position for stitching the portions together, where, when the various components are in a flat condition, the regions (corresponding to the desired stitching paths) of the various components are not in overlapping relationship; that is to say, the pallet enables distortion of at least one of the components in order to bring the regions of the various components into such overlapping relationship. This is achieved by locating e.g. the quarter portions RQ, LQ in a flat condition in relation to a slot (14) of the pallet, which slot corresponds with the desired stitching path, and thereafter positioning the other component, e.g. the vamp V, with part of said region thereof in overlapping relationship with corresponding parts of the quarter portions, and clamping the vamp so that the parts of the regions thereof and of the quarter portions are maintained in overlapping relationship. Thereafter, the remainder of the regions of the vamp can be positioned by distorting the vamp manually, whereafter the vamp is clamped in distorted condition, maintaining the remainder of the regions in such overlapping relationship.

11 Claims, 3 Drawing Figures

METHOD FOR POSITIONING TWO WORKPIECE PORTIONS FOR STITCHING TOGETHER ALONG A DESIRED STITCHING PATH

BACKGROUND OF THE INVENTION (1.) Field of the Invention

This invention is concerned with a method of positioning two workpiece portions for stitching together along a desired stitching path, and more particularly a method of using a pallet to position portions of a shoe upper for stitching.

(2.) Summary of the Prior Art

In many instances, especially in using automatic sewing machines, it is conventional to utilize a so-called pallet by which two workpiece portions to be stitched together can be first positioned in a desired overlapping relationship and then be clamped in such relationship prior to being presented to stitching instrumentalities of a sewing machine. One such pallet is described in U.K. Patent Specification No. 1473687. Such a pallet is provided with a base portion having a slot corresponding to the desired stitching path, workpiece positioning means by which a first workpiece portion can be positioned with the region, corresponding to the desired stitching path, thereof in alignment with the slot, while the workpiece portion is in a substantially flat condition, and second workpiece positioning means whereby a second portion, also in a substantially flat condition, can be positioned, in superposed relationship with the first portion, and with its region, corresponding to the desired stitching path, in alignment with the slot, the two workpiece portions being clamped together by appropriate clamp means in such alignment.

In the manufacture of certain workpieces, however, e.g. the manufacture of shoes, it often arises that the regions of the two workpiece portions do not overlap over the whole of their length when the workpiece portions are in a substantially flat condition; that is to say, in joining the workpiece portions together, it is desirable to take into account the final three-dimensional shape of the finished article. It will be appreciated that, under such circumstances, a pallet of the type referred to above will not normally be able to be used for the positioning of the two workpiece portions for the stitching operation to be performed thereon. On the other hand, it is most desirable that, where two workpiece portions are to be stitched together as aforesaid, they are accurately positioned in the regions to be stitched, in order to ensure the quality of the finished article.

It is therefore the object of the present invention to provide an improved method of positioning two workpieces for stitching together along a desired stitching path, said workpiece portions each having a region corresponding to said stitching path, which regions do not overlap along the whole of their length when the workpiece portions are in a flat condition, in carrying out which method the operator can nevertheless accurately position the regions of each workpiece portion in an overlapping relationship in which it can be clamped during the stitching operation.

BRIEF SUMMARY OF THE INVENTION

The present invention provides a method of positioning two workpiece portions for stitching together along a desired stitching path, said workpiece portions each having a region corresponding to said stitching path, which regions do not overlap along the whole of their length when the workpiece portions are in a flat condition, the method comprising the steps of positioning the two workpiece portions in a substantially flat condition, with part of said region of each thereof in an overlapping relationship and clamping the portions so as to maintain such overlapping relationship, of said parts of the regions, thereafter distorting at least one of the workpiece portions to bring the remainder of the regions of each of the portions into overlapping relationship, and clamping the portions so as to maintain such overlapping relationship of the remainder of said regions.

It will thus be appreciated that, in using the method in accordance with the invention, the regions, corresponding to the desired stitching path, of the two workpiece portions are brought into, and clamped in, the desired overlapping relationship, the necessary distortion arising from such positioning of the regions being prevented, by the clamping means, from interfering with the maintenance of such overlapping relationship during a subsequent stitching operation.

Preferably, in carrying out the method in accordance with the invention, a pallet is used having a slot corresponding to the desired stitching path, and first and second workpiece positioning means disposed in such a relationship with the slot as to enable the workpiece portions to be positioned as aforesaid with said regions thereof in overlapping relationship with each other and with the slot, at least one of said workpiece positioning means having a first part by which part of said region of one of the workpiece portions can be positioned in a substantially flat condition, said one portion then being clamped as aforesaid, and also having a second part with which the remainder of said region is not aligned when the portion is in said substantially flat condition, but by which the remainder of said region can be positioned upon distortion of said workpiece portion as aforesaid.

It will thus be appreciated that, in this pallet, the workpiece positioning means, especially the second workpiece positioning means, is determined by the stitching path to be followed, rather than by the general outline of the workpiece portions to be positioned thereby, so that the necessary distortion of one of the workpiece portions is achieved by means of the shape of the workpiece positioning means.

In carrying out the method in accordance with the invention, conveniently the first workpiece portion is located in a substantially flat condition and the second workpiece portion, also in a substantially flat condition, is then positioned in superposed relationship therewith, with part of said region of said second workpiece portion in overlapping relationship with a corresponding part of the region of the first portion, but with the remainder of said region not in such overlapping relationship, the second workpiece portion then being clamped against the first portion to maintain such overlapping relationship, and wherein the second workpiece portion, while thus clamped, is then distorted out of its substantially flat condition to bring the remainder of said region thereof into overlapping relationship with the remainder of the region of the first portion and is then clamped in such overlapping relationship.

More particularly, where a pallet is used as aforesaid, conveniently a first one of the workpiece portions, in a substantially flat condition, is positioned by the first workpiece positioning means with said region of the portion in alignment with the slot of the pallet along the whole of the length of said region, and part of the region of the second workpiece portion, in a substantially flat condition, is positioned by the first part of the second workpiece positioning means also in alignment with the slot but along said part only of the length of said region, the two portions being in superposed relationship, whereafter the two portions are clamped to maintain both portions in such alignment with the slot, the second portion then being distorted to position the remainder of said region thereof, by the second part of the second workpiece positioning means, in alignment with the slot over the length of such remainder of the region, and the second portion being then further clamped to maintain it in alignment with the slot over the whole length of said region thereof.

The pallet used in carrying out the method in accordance with the invention preferably comprises a base portion having a slot therein and supporting the first workpiece positioning means, a second portion supporting the second workpiece positioning means, first clamp means which, in co-operation with said second portion, is effective to cause the two workpiece portions to be clamped thus to maintain said part of the region of each portion in alignment with the slot, and second clamp means by which the second portion, when positioned with the region thereof is alignment with the slot along the whole of its length, is clamped against the base and second portions of the pallet.

It will thus be appreciated that, by the provision of first and second clamp means, the workpiece portions are progressively clamped in a desired relationship with one another, whereby to enable the distortion to take place without detriment to any positioning of the regions of the workpiece portions which has already taken place.

Conveniently the first clamp means of the pallet is mounted on the second portion thereof, and further, if desired, the base portion, second portion and second clamp means of the pallet may be hinged together in the form of a book. Furthermore, in order to maintain clamping pressure, conveniently each clamp means has releasable locking means associated therewith.

The method in accordance with the invention has been found especially suitable, though not exclusively so, where the workpiece portions are constituted by a vamp and a quarter portion of a shoe upper. (Other applications for the method in accordance with the invention could be found in e.g. the manufacture of the toe end of a shoe upper for a so-called brogue shoe, where the so-called wing cap is to be stitched to the vamp).

In carrying out the method in accordance with the invention where the workpiece portions are so constituted, preferably a pallet is procured having a slot corresponding to the desired stitching path, the quarter portion being positioned, by means of first workpiece positioning means, in a substantially flat condition with the region thereof in alignment with the slot, second workpiece positioning means are then located, in superposed relationship with the quarter portion, and the vamp is positioned, by said second means in a substantially flat condition with part of the region thereof, extending along the so-called facing portion thereof, in alignment with the slot, but such that the remainder of the region, along the "wing" portion of the vamp is not in such alignment, the vamp is then clamped in such alignment, along the facing portion thereof, the vamp is then distorted to bring the remainder of the region thereof, extending along the wing portion thereof, into alignment with the slot, and the vamp is then clamped, adjacent to the wing portion thereof, in such alignment. The effect of so clamping the vamp in its distorted condition is to cause a bulge to be formed toewardly of the clamping means, which bulge, in the finished shoe, is taken up by the forming of the toe region of the shoe upper of a shoe last. The bulge also facilitates the fitting of the upper to the shoe last prior to the lasting operation.

It will of course be appreciated that, in a conventional shoe upper, two quarter portions are provided, stitched to the vamp, one at each side thereof by a so-called side seam (which will of course vary according to the style of shoe). In general, where the workpiece portions cannot be stitched together when both are in a substantially flat condition, it is customary for the opposite sides of the shoe upper to be operated upon one after the other. The method in accordance with the present invention, on the other hand, facilitates the clamping of two quarter portions and a vamp in desired overlapping relationships with a view to both sides being stitched for a single positioning and clamping of the various components. To this end, preferably the pallet is provided with two slots, which each correspond to a desired stitching pattern and in alignment with each of which one quarter portion is positioned as aforesaid, by associated first workpiece positioning means, the vamp (having two regions corresponding each to a desired stitching path) is positioned by the second positioning means with the part of each region thereof, extending along the facing portion, in alignment with the slots and is clamped as aforesaid, and the vamp is then distorted to bring the remainder of each region, extending along the wing portions of the vamp, into alignment with the slots and is again clamped in such alignment.

BRIEF DESCRIPTION OF THE DRAWINGS

There now follows a detailed description, to be read with reference to the accompanying drawings, of one method in accordance with the invention, and also of a pallet for use of carrying out such method. It will be appreciated that this method and pallet have been selected for description merely by way of exemplification of the invention and not by way of limitation thereof.

In the accompanying drawings.

DESCRIPTION OF THE PREFERRED EMBODIMENTS

In carrying out the method now to be described, a pallet is used comprising a base plate 10 which is supported by a pallet locating member 12, by which the pallet can be accurately located in an automatic stitching machine of the type shown e.g. in U.K. Patent Application Publication No. 2041022.

The base plate 10 has formed therein two slots 14 corresponding to a desired stitching path to be effected by a needle 44 (see FIG. 3) of a sewing machine.

Figure 1:
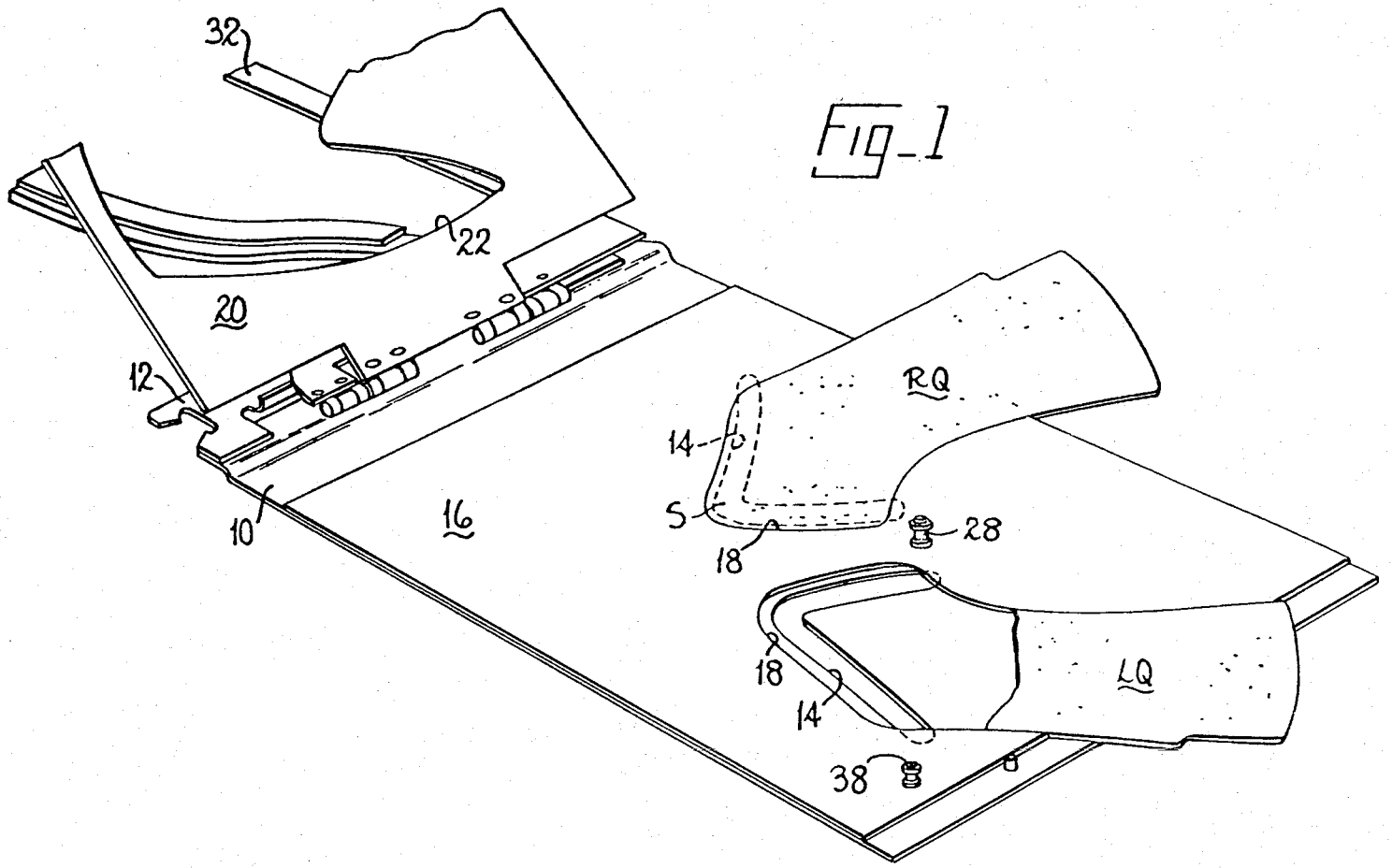
FIG. 1 is a perspective view showing a base portion of a pallet with two quarter portions of a shoe upper located by first positioning means thereof.

Supported on the base plate 10 is a first workpiece positioning plate 16 having two cut-outs 18 by which two quarter portions LQ, RQ can be located in such a way that a region S of each quarter portion (one only shown in FIG. 1), corresponding to the said stitching path, is located in alignment with the slot 14 while lying on the base plate 10 in a substantially flat condition.

The base plate 10 and pallet locating member 12 are secured together and together constitute a base portion of the pallet.

Hinged on the base plate 10 is a second portion 20 of the pallet (FIG. 2), which portion can be swung into superposed relationship with the base portion 10, 16 and with the quarter portions LQ, RQ of the shoe upper. The second portion 20 has a cut-out 22 constituting second workpiece positioning means by which a vamp V of a shoe upper can be positioned in the pallet. The vamp in the shoe upper shown in FIG. 2 is to be stitched to the quarter portions along a side seam which extends from the feather line of the shoe upper inwardly and then is directed through an angle and extends along the length of the so-called facing portions F of the vamp; the facing portions are provided conventionally with eyelet holes through which laces can pass in the finished shoe.

The cut-out 22 has a locating edge in four sections *22a, 22b, 22c, 22d,* and each section extends adjacent an edge of the slots 14 in the base plate 10. The edge sections *22a, 22c,* are associated with the slot 14 for the right hand quarter portion RQ, while the sections *22b, 22d* are associated with the slot 14 for the left-hand quarter portion LQ. The sections *22a, 22b* serve to position the region, corresponding to the stitching path, of the facing portions F of the vamp, while the sections *22c, 22d* serve to position the regions, corresponding to the stitching paths, of the wing portions of the vamp V.

Figure 2:
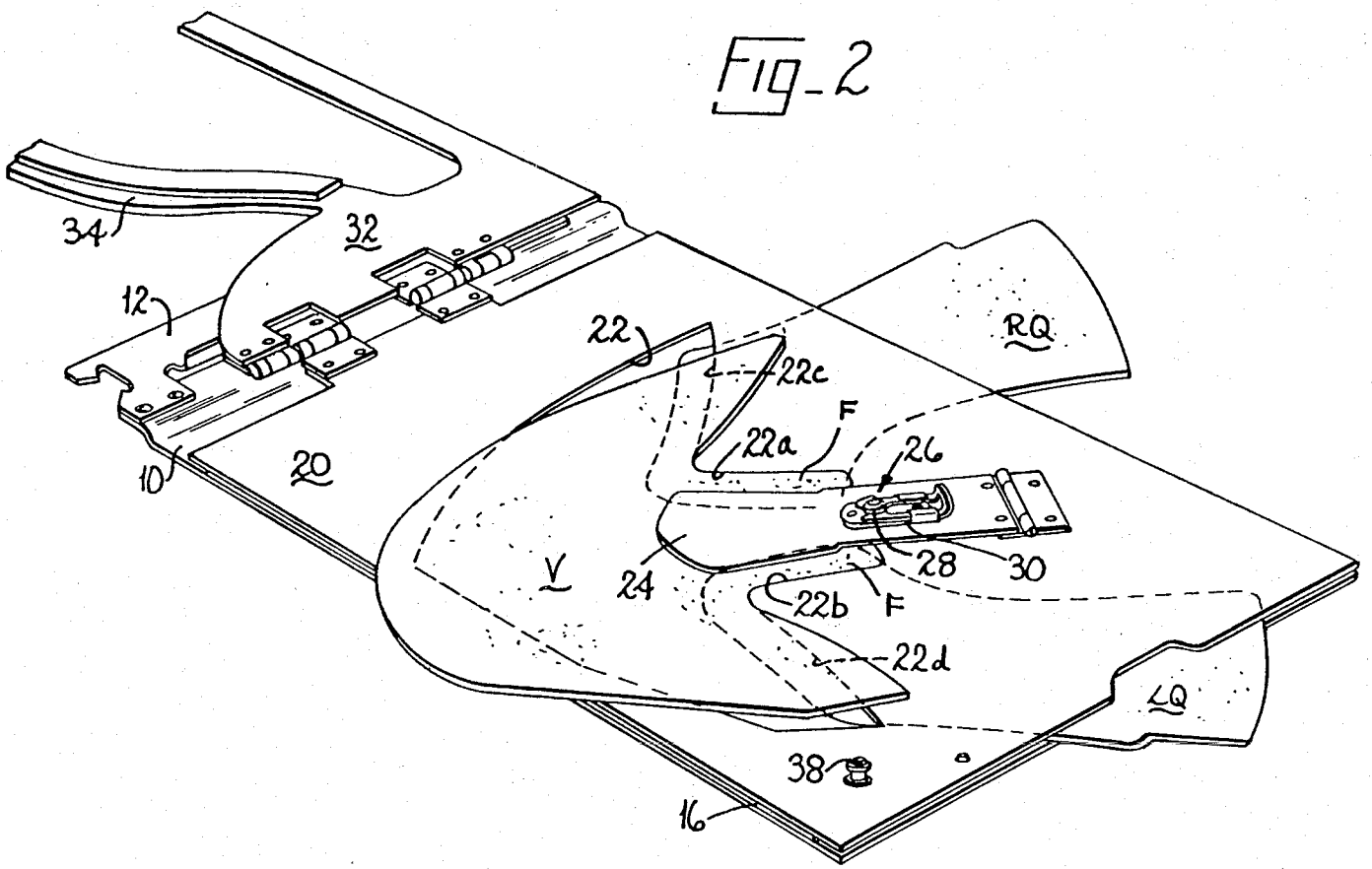
FIG. 2 is a view similar to FIG. 1, but showing a second portion of the pallet, with a vamp of a shoe upper located in the region of the facing portions thereof and clamped.

As will be seen in FIG. 2, the relationship between the edges of the facing portion F and its associated wing portion is different from the relationship between the section *22a* and section *22c* (and of course *22b* and *22d*). Thus, in locating the facing portions F of the vamp by the sections *22a, 22b,* the regions, corresponding to the stitching paths, of the facing portions F are brought into overlapping relationship with the corresponding regions of the quarter portions RQ, LQ and in alignment with the slots 14, while the regions extending along the wing portions of the vamp V are not positioned in such a relationship.

For securing the facing portions F of the vamp V, once located by the sections *22a, 22b,* the pallet also comprises first clamp means in the form of a clamp member 24 hinged on the second portion 20 of the pallet. The clamp member 24 is relatively broad but is so dimensioned as not to overlap the slots 14. Furthermore, for securing the clamp member in clamping position, a releasable locking arrangement generally designated 26 is provided, comprising a stud 28 carried on the plate 16 and clampingly engageable by a bifurcated slide 30 carried on the clamp member 24. The second portion 20 of the pallet and the clamp member 24 have aligned apertures through which, when the second portion 20 is hinged into superposed relationship with the plate 16, the stud 28 projects at a level for engagement by the slide 30.

With the pallet still in the condition shown in FIG. 2, and with the facing portions F of the vamp V positioned by the sections *22a, 22b,* the vamp V can then be distorted manually by the operator to bring the remainder of the regions, corresponding to the stitching paths, and extending along the wing portions of the vamp, into a desired overlapping relationship with corresponding parts of the regions of the quarter portions RQ, LQ, and into alignment with the slots 14. As will be seen from FIG. 3, furthermore, this distortion of the vamp V causes bulges B to be created towards the toeward end of the vamp. The wing portions of the vamp are of course positioned as aforesaid by engagement with the sections *22c, 22d,* of the second workpiece positioning means.

For clamping the vamp V, along the wing portions thereof, in its distorted condition, the pallet comprises second clamp means in the form of a clamp plate 32 which is hinged on the base plate 10 and can be hinged over into superposed position with the other integers of the pallet. The external dimensions of the plate 32 are similar to those of the second portion 20 and plates 10, 16, but the plate 32 is largely cut away, thus avoiding any fouling on the first clamp means and the releasable locking arrangement, and essentially comprises a clamp bar 34 which extends across the vamp V positioned as aforesaid, along a line generally parallel to the edge of the wing portions of the vamp. That is to say, the clamp bar 34 clamps the vamp adjacent the slots 14, but does not overlap them.

For securing the clamp plate 32 in clamping engagement as aforesaid, a further releasable locking arrangement generally designated 36 is provided, comprising a further stud 38 mounted on the plate 16 and projecting through appropriate apertures in the second portion 20 and plate 32, a bifurcated slide 30 being mounted on the plate 32 for clamping engagement with said stud.

In using the aforementioned pallet, in carrying out the method in accordance with the invention, the quarter portions RQ, LQ are first located as aforementioned on the plate 16, in a substantially flat condition. The second portion 20 of the pallet then serves to maintain the quarter portions in such position while at the same time enabling the vamp to be located, along the part of the regions thereof (corresponding to the stitching paths) in overlapping relation with corresponding parts of the regions of the quarter portions and in alignment with the slots 14. In this condition, however, since the vamp V is at this time in a substantially flat condition, the wing portions thereof are not in a desired relationship with the quarter portions and the slots. In order to ensure that the positioned parts of the regions of the vamp V are maintained as positioned, the first clamp means including the clamp member 24 is applied and locked in position by the arrangement 26. In this condition, the vamp can now no longer move relative to the pallet in the region of the facing portions F thereof, and also the first clamp means, in co-operation with the second portion 20 of the pallet, now maintains the quarter portions RQ, LQ in position.

The operator then manually causes distortion of the vamp by bringing edges of the wing portions into engagement with the sections *22c, 22d,* so that the remainder of the regions (corresponding to the desired stitch paths) of the vamp, extending along the wing portions, are brought into the desired overlapping relationship with corresponding parts of the regions of the quarter portions and also into alignment with the slots. This distortion causes bulges B to be formed in the vamp, toewardly of the wing portions, which bulges subsequently serves better to enable the shoe upper to fit to a three-dimensional last. In addition, in the particular embodiment now being described, the bulges also serve to urge the edges of the wing portions of the vamp against the sections *22c, 22d,* ( In other embodiments of the invention, the effect of distortion may be to urge the portions of the vamp or other component being located away from the positioning means.)

With the distorted vamp thus located, the clamp plate 32 is hinged over into superposed relationship with the remainder of the pallet thereby clamping the vamp adjacent the wing portions thereof, and the plate is then locked in clamping engagement by the arrangement 36.

The shoe upper components are now ready for the stitching operation to be performed, and the pallet can now be located in a sewing machine as aforementioned by means of the member 12.

Figure 3:
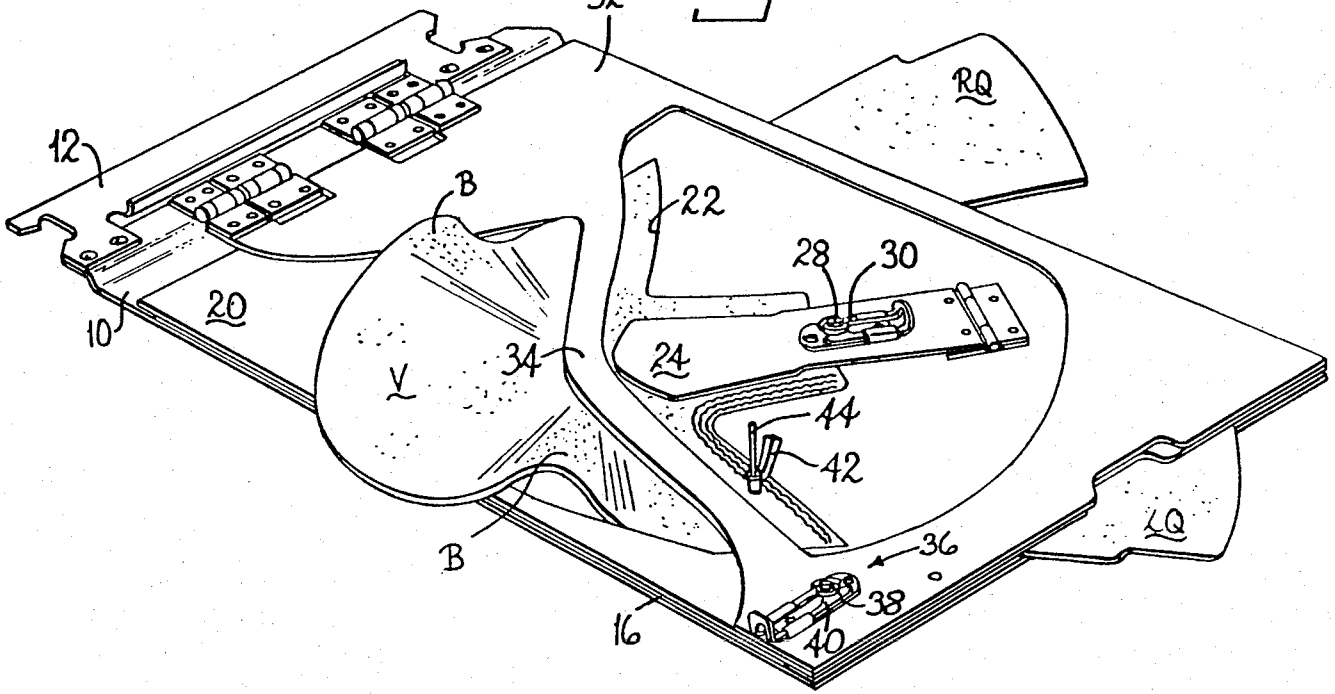
FIG. 3 is a view similar to FIG. 2 showing the vamp positioned along the whole of the length of the region thereof to be stitched, and clamped in a distorted condition.

In FIG. 3 is shown a needle 44 and presser foot 42, forming part of an automatic sewing machine in which the pallet is to be positioned. The sort of stitch path envisaged for this application is shown by way of example in FIG. 3, three lines of stitching being indicated on the left-hand side of the vamp, and of course a comparable pattern would be expected to be applied subsequently to the right-hand side.

It will be appreciated that, in using the pallet referred to above in carrying out the method according to the invention the regions being stitched will be maintained in a substantially flat condition during stitching, thereby facilitating the stitching operation.

It will further be appreciated that, whereas in the method described above the vamp is secured to two quarter portions while they are clamped up together in the manner described, nevertheless if desired the pallet could be used for the stitching of only one quarter portion to the vamp, in which case distortion of the vamp in the same manner as described above will still be required.

We claim:

1. A method of positioning two workpiece portions for stitching together along a desired stitching path, said workpiece portions each having a region corresponding to said stitching path, which regions do not overlap along the whole of their length when the workpiece portions are in a flat condition, the method comprising the steps of:

positioning the two workpiece portions, in a substantially flat condition, with part of said region of each thereof in an overlapping relationship;

clamping the portions so as to maintain such overlapping relationship of said parts of the regions;

distorting thereafter at least one of the workpiece portions to bring the remainder of the regions of each of the portions into overlapping relationship; and clamping the portions so as to maintain such overlapping relationships of the remainder of said regions.

2. A method according to claim 1:

using a pallet having a slot corresponding to the desired stitching path, and first and second workpiece positioning means disposed in such a relationship with the slot as to enable the workpiece portions to be positioned as aforesaid with said regions thereof in overlapping relationship with each other and with the slot, at least one of said workpiece positioning means having a first part by which part of said region of one of the workpiece portions can be positioned in a substantially flat condition, said one portion thus being clamped as aforesaid, and also having a second part with which the remainder of said region is not aligned when the portion is in said substantially flat condition, but by which the remainder of said region can be positioned upon distortion of said workpiece portion as aforesaid.

3. A method according to claim 1 wherein the first workpiece portion is located in a substantially flat condition and the second workpiece portion, also in a substantially flat condition, is then positioned in superposed relationship therewith, with part of said region of said second workpiece portion in overlapping relationship with a corresponding part of the region of the first portion, but with the remainder of said region not in such overlapping relationship, the second workpiece portion then being clamped against the first portion to maintain such overlapping relationship, and wherein the second workpiece portion, while thus clamped, is then distorted out of it substantially flat condition to bring the remainder of said region thereof into overlapping relationship with the remainder of the region of the first position and is then clamped in such overlapping relationship.

4. A method according to claim 2 wherein a first one of the workpiece portions, with said region in a substantially flat condition, is positioned by the first workpiece positioning means of the portion in alignment with the slot of the pallet along the whole of the length of said region, and part of the region of the second workpiece portion, in a substantially flat condition, is positioned by the first part of the second workpiece positioning means, also in alignment with the slot but along said part only of the length of said region, the two portions being in superposed relationship, whereafter the two portions are clamped to maintain both portions in such alignment with the slot, the second portion then being distorted to position the remainder of said region thereof, by the second part of the second workpiece positioning means, in alignment with the slot over the length of such remainder of the region, and the second portion being then further clamped to maintain it in alignment with the slot over the whole length of said region thereof.

5. A method according to claim 4 wherein the pallet used comprises a base portion having the slot therein and supporting the first workpiece positioning means, a second portion supporting the second workpiece positioning means, first clamp means which, in co-operation with said second portion, is effective to cause the two workpiece portions to be clamped thus to maintain said part of the region of each portion in alignment with the slot, and second clamp means by which the second portion, when positioned with the region thereof in alignment with the slot along the whole of its length, is clamped against the base and second portions of the pallet.

6. A method according to claim 5 wherein the first clamp means is mounted on the second portion of the pallet.

7. A method according to claim 6 wherein the base portion, second portion and second clamp means are hinged together in the form of a book.

8. Method according to claim 5 wherein each clamp means has releasable locking means associated therewith.

9. Method according to claim 5 wherein the workpiece portions are constituted by a vamp and a quarter portion of a shoe upper.

10. A method according to claim 1 wherein the workpiece portions are constituted by a vamp and a quarter portion of a shoe upper, said method comprising:

procuring a pallet having a slot corresponding to the desired stitching path;

positioning, by means of first workpiece positioning means, the quarter portion in a substantially flat condition with the region thereof in alignment with the slot;

locating second workpiece positioning means in superposed relationship with the quarter portion and positioning the vamp, by said second means, in a substantially flat condition, with part of the region thereof, extending along the so-called facing portion thereof, in alignment with the slot, but such that the remainder of the region, along the "wing" portion of the vamp is not in such alignment;

clamping the vamp in such alignment, along the facing portion thereof;

distorting the vamp to bring the remainder of said region thereof, extending along the wing portion thereof, into alignment with the slot; and clamping the vamp, adjacent the wing portion thereof, in such alignment.

11. A method according to claim 10 wherein two quarter portions are to be stitched one at each side of the vamp, the pallet being provided with two slots which each correspond to a desired stitching path and in alignment with each of which one quarter portion is positioned as aforesaid, by associated first workpiece positioning means, the vamp (having two regions corresponding each to a desired stitching path) is positioned by the second positioning means with the part of each region thereof, extending along the facing portions, in alignment with the slots and is clamped as aforesaid, and the vamp is then distorted to bring the remainder of each region, extending along the wing portions of the vamp, into alignment with the slots and is again clamped in such alignment.

* * * * *